US010487492B2

(12) United States Patent
Boersma

(10) Patent No.: US 10,487,492 B2
(45) Date of Patent: Nov. 26, 2019

(54) ENHANCED DRAIN COVER

(71) Applicant: Iodon, Inc., Country Club Hills, IL (US)

(72) Inventor: Donald Boersma, Country Club Hills, IL (US)

( * ) Notice: Subject to any disclaimer, the term of this patent is extended or adjusted under 35 U.S.C. 154(b) by 0 days.

(21) Appl. No.: 15/336,031

(22) Filed: Oct. 27, 2016

(65) Prior Publication Data

US 2018/0119404 A1 May 3, 2018

(51) Int. Cl.
*E03F 5/06* (2006.01)
*E03F 5/04* (2006.01)

(52) U.S. Cl.
CPC ..... *E03F 5/06* (2013.01); *E03F 5/0408* (2013.01)

(58) Field of Classification Search
None
See application file for complete search history.

(56) References Cited

U.S. PATENT DOCUMENTS 782,860 A * 2/1905 Lever ..... E03C 1/264 285/192
1,195,827 A * 8/1916 Lucke ..... E03C 1/22 210/163
1,494,882 A * 5/1924 Barger ..... E03C 1/264 4/292
1,595,516 A * 8/1926 Happ ..... E03C 1/262 4/287
1,660,010 A * 2/1928 Lemm ..... E03C 1/262 4/287
1,741,242 A * 12/1929 Lemm ..... E03C 1/264 4/287
3,212,416 A * 10/1965 Boersma ..... E03F 5/06 210/163
3,674,149 A * 7/1972 Donalson ..... E03F 5/0407 210/163
D256,948 S 9/1980 Boersma
4,257,892 A 3/1981 Boersma
4,655,913 A 4/1987 Beorsma
4,871,451 A * 10/1989 Piskula ..... E03F 5/0407 210/164
4,910,811 A * 3/1990 Izzi, Sr. ..... E03C 1/262 210/163

(Continued)

FOREIGN PATENT DOCUMENTS

CA 1134754 11/1982
CA 1284298 11/1986

*Primary Examiner* — Robert J Popovics

(57) ABSTRACT

A drain cover includes: (a) a cover portion including a first plate portion defining a plurality of first holes, the first plate portion including a first top surface and a first bottom surface; (b) a securing portion including a second plate portion, the second plate portion including a second top surface and a second bottom surface, the first bottom surface being flush against and in contact with the second top surface, the second plate portion defining a plurality of second holes coaxial with the first holes; (c) a plurality of draw necks comprising a corresponding plurality of neck extensions that form lamination-retention collars, each of the plurality of retention collars including an upper surface and a lower surface, the upper surfaces being at least partially flush against and in contact with the second bottom surface, the lower surfaces being curved and flared.

15 Claims, 4 Drawing Sheets

(56) References Cited

U.S. PATENT DOCUMENTS

| | | | | | |
|---|---|---|---|---|---|
| 5,071,177 | A * | 12/1991 | Spiess | E02D 29/1427 | 292/214 |
| D348,924 | S * | 7/1994 | Merrett | D23/261 | |
| 6,175,971 | B1 * | 1/2001 | O'Neill | E03C 1/22 | 4/288 |
| D550,819 | S * | 9/2007 | Seehoff | D23/261 | |
| D563,529 | S * | 3/2008 | Labonte | D23/261 | |
| 8,557,109 | B1 * | 10/2013 | Sutherland | E03F 5/0409 | 210/163 |
| 8,834,714 | B2 * | 9/2014 | Chien | E03F 1/00 | 210/163 |
| 8,869,319 | B2 * | 10/2014 | Griffin | E04H 4/14 | 4/507 |
| D726,886 | S * | 4/2015 | Sutherland | D23/261 | |
| 9,175,797 | B1 * | 11/2015 | Behoteguy | F16L 55/115 | |
| 9,611,630 | B2 * | 4/2017 | Danhi | E03C 1/22 | |
| 2014/0069854 | A1 * | 3/2014 | Sutherland | E03F 5/0404 | 210/163 |
| 2018/0100298 | A1 * | 4/2018 | Willburn | E03C 1/26 | |
| 2018/0119404 | A1 * | 5/2018 | Boersma | E03F 5/0408 | |

* cited by examiner

ENHANCED DRAIN COVER

TECHNICAL FIELD

The present invention generally relates to drain grates, which cover openings of drains or drain pipes.

BACKGROUND

Drain covers (also referred to as drain grates) protect drain openings. Drain covers may be found, for example, in floor drains and showers. Typically, drain covers sit on top of a drain pipe and thus cover or protect drain pipe openings. Drain covers prevent small objects (e.g., wrist watches, keys, rings, etc.) from entering the drain pipes. Fluid (e.g., water), under force of gravity, flows through the drain cover's holes and into the drain pipes.

The edges of drain covers defining drain cover holes may be sharp. In the event that a person mishandles a drain cover, the sharp edges may cut their fingers. A solution is needed to mitigate this hazard.

Existing drain covers are disclosed, for example, in Canadian Patent Nos. 1,134,754 and 1,284,29, U.S. Pat. Nos. 3,212,416, 4,257,892, and 4,655,913, and U.S. Design Pat. No. 256,948. All of these patents are hereby incorporated by reference in their entireties.

SUMMARY

A drain cover includes: (a) a cover portion including a first plate portion defining a plurality of first holes, the first plate portion including a first top surface and a first bottom surface; (b) a securing portion including a second plate portion, the second plate portion including a second top surface and a second bottom surface, the first bottom surface being flush against and in contact with the second top surface, the second plate portion defining a plurality of second holes coaxial with the first holes; (c) a plurality of rings, each of the plurality of rings including an upper surface and a lower surface, the upper surfaces being at least partially flush against and in contact with the second bottom surface, the bottom surfaces being curved and smooth.

BRIEF DESCRIPTION OF THE DRAWINGS

For a better understanding of the invention, reference may be made to embodiments shown in the following drawings. The components in the drawings are not necessarily to scale and related elements may be omitted, or in some instances proportions may have been exaggerated, so as to emphasize and clearly illustrate the novel features described herein. In addition, system components can be variously arranged, as known in the art. Further, in the drawings, like reference numerals designate corresponding parts throughout the several views.

FIG. 2*a* is seen from the same perspective as the viewing plane of FIG. 1. FIG. 2*a* shows draw necks having an open perimeter for clarity.

FIG. 3 omits views of at least some legs of the securing portion.

FIG. 4 omits views of at least some legs of the securing portion and also omits view of support tabs of the securing portion. FIG. 4 omits features of draw necks extending through holes 51.

FIG. 5 is seen from the same perspective as the viewing plane of FIG. 1. Hidden features of FIG. 5 are dashed.

FIG. 6*a* is a partial side plan view of the cover portion mated with the securing portion prior to full assembly. FIG. 6*a* is seen from the same perspective as the viewing plane of FIG. 1. Hidden features of FIG. 6*a* are dashed. FIG. 6*a* may omit certain features shown in FIGS. 1, 2, 3, and 4.

FIG. 6*b* is a partial side plan view of the cover portion mated with the securing portion upon full assembly. FIG. 6*b* is seen from the same perspective as the viewing plane of FIG. 1. Hidden features of FIG. 6*b* are dashed. FIG. 6*b* may omit certain features shown in FIGS. 1, 2, 3, and 4.

DETAILED DESCRIPTION OF EXAMPLE EMBODIMENTS

Figure 1:
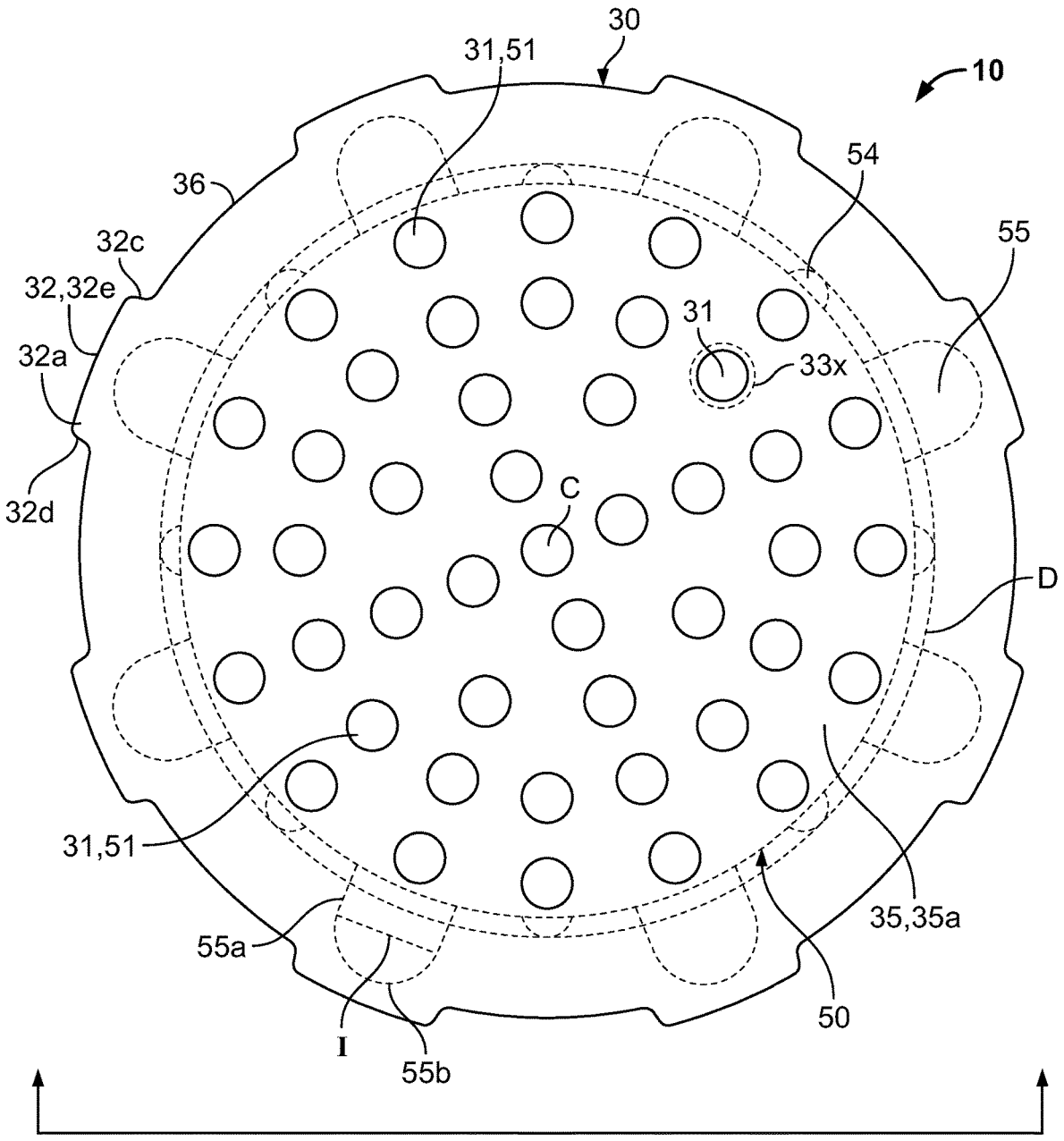
FIG. 1 is a top plan view of a fully assembled drain cover including a cover portion or assembly and a securing portion or assembly. According to some embodiments, reference circumference D may correspond to an inner circumference of a drain pipe extending parallel to centerline C and receiving the drain cover. Hidden features are dashed.

While the invention may be embodied in various forms, there are shown in the drawings, and will hereinafter be described, some exemplary and non-limiting embodiments, with the understanding that the present disclosure is to be considered an exemplification of the invention and is not intended to limit the invention to the specific embodiments illustrated.

In this application, the use of the disjunctive is intended to include the conjunctive. The use of definite or indefinite articles is not intended to indicate cardinality. In particular, a reference to "the" object or "a" and "an" object is intended to denote also one of a possible plurality of such objects. Further, the conjunction "or" may be used to convey features that are simultaneously present instead of mutually exclusive alternatives. In other words, the conjunction "or" should be understood to include "and/or" as one possible option and "either/or" as another possible option.

With reference to FIG. 1, drain cover 10 includes cover portion 30 and securing portion 50. Cover portion 30 lies above securing portion 50. Securing portion 50 is configured to pressure fit and grip into drain pipe D. Drain pipe D is omitted in the other Figures.

Plate portion 35 of cover portion 30 has a diameter greater than the diameter of drain pipe D and plate portion 52 of securing portion 50 has a diameter less than the diameter of drain pipe D. In the illustrated embodiment, drain pipe D has a 4 inch diameter, plate portion 35 of cover portion 30 has a 5 and ⅛ inch diameter (or plate portion 35 and the combination of two opposing projections 32 has a 5 and ⅛ inch diameter), and plate portion 52 of securing portion 50 has a 3 and ⅞ inch diameter (or plate portion 52 and the combination of two opposing legs 53 has a 3 and ⅞ inch diameter).

It should be appreciated that drain cover 10 may be sized and configured to fit drain pipes with different shapes and sizes. According to some embodiments, drain cover assembly is fully or at least partially made from stainless steel. According to some embodiments, cover portion 30 is made from 0.050 inches prime stainless steel.

Fluid (e.g., water) enters drain pipe D by passing through or under cover portion 30 (specifically, through holes 31 or weep openings 36), through or past securing portion 50 (specifically through holes 51 or between the outer diameter of plate portion 52 and pipe D), and into drain pipe D. Drain cover 10 has enhanced strength and durability because the lamination of cover portion 30 with securing portion 50 provides an enhanced thickness along centerline C.

Figure 2A:
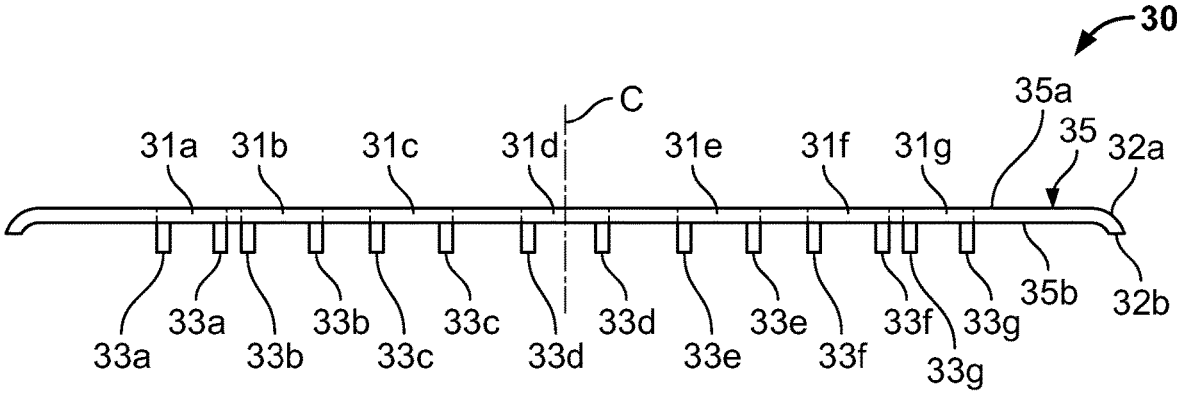
FIG. 2*a* is a side plan view of the cover portion prior to full assembly. Holes of the cover portion are hidden from this perspective and are thus dashed.

With reference to FIGS. 1 and 2*a*, cover portion 30 includes a flat and circular plate portion 35 integral with projections 32. Plate portion 35 includes a flat top surface 35*a* and a flat bottom surface 35*b*. Upon full assembly and installation into drain pipe D, top surface 35*a* is typically exposed while bottom surface 35*b* firmly contacts securing portion 50.

Plate portion 35 defines holes 31. Holes 31 are preferably circular, preferably with diameters of ¼ inch. Holes 31 are configured to accept fluid (e.g., water). Holes 31 may be arranged in any suitable pattern. According to less preferred (but still advantageous) embodiments, holes 31 may appear to be oval-shaped when viewed from a top plan perspective; however, they are circular with approximately ¼ inch diameters.

Projections 32 are integral with plate portion 35. As shown in FIG. 1, projections 32 extend at a common interval from plate portion 35. Projections 32 include curved portions 32*a* and flat bottoms 32*b*. Both of curved portions 32*a* and flat bottoms 32*b* extend from a first side 32*c* of each projection 32 to a second side 32*d* of each projection 32. Upon installation, flat bottoms 32*b* will preferably sit flush against the flooring (e.g., a shower base) surrounding drain pipe D, and less preferably (but still advantageously) may sit partially above an uneven pipe, or uneven flooring.

When seen from the top plan view of FIG. 1, outer-most surfaces 32*e* (i.e., the surfaces connecting first sides 32*c* to second sides 32*d*) may be straight or may be curved. When the outer-most surfaces 32*e* are curved, a reference circumference about centerline C (not shown) intersects and is co-circumferential with each of the outer-most surfaces.

Upon full assembly, and as shown in FIG. 1, projections 32 align with tabs 55. Upon hill assembly, curved portions 32*a* of projections 32 at least partially protect tabs 55 (i.e., curved portions 32*a* at least partially hide or obscure tabs 55 when drain cover 10 is seen from the viewing plane).

Weep openings 36 are defined between adjacent projections 32. Upon installation into drain pipe D, weep openings 36 accept fluid flowing along the floor surrounding drain pipe D (e.g., a shower base). Fluid passes through weep openings 36, between plate portion 35 and the flooring, and into drain pipe D.

Figure 3:
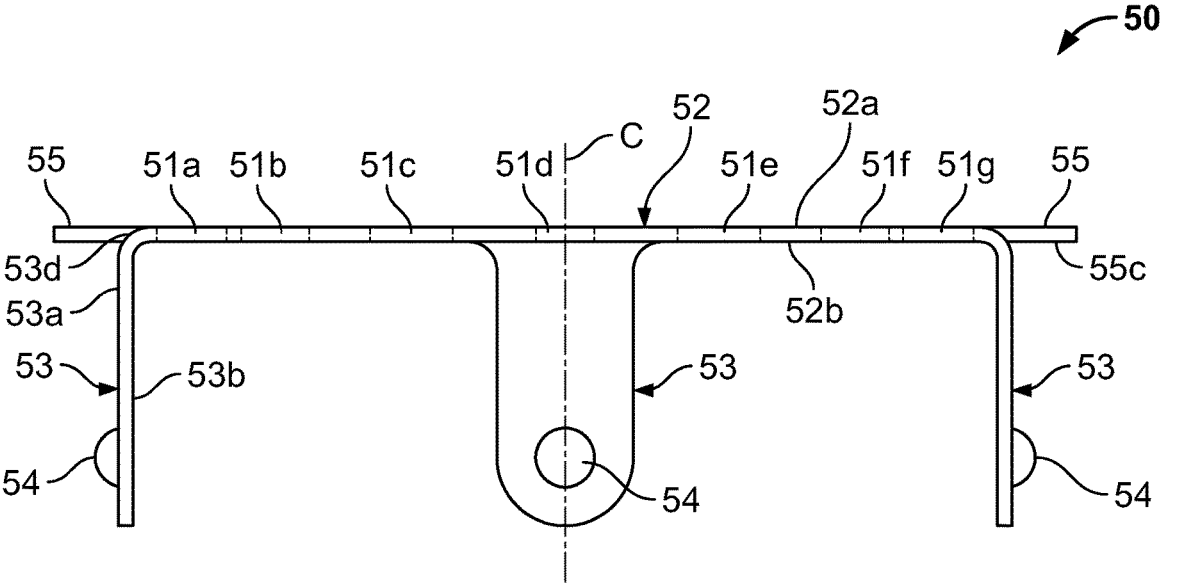
FIG. 3 is a side plan view of the securing portion seen from the viewing plane of FIG. 1. Holes of the securing portion are hidden from this perspective and are thus dashed.

With reference to FIGS. 1 and 3, securing portion 50 includes a flat and circular plate portion 52, tabs 55, and legs 53. Circular plate portion 52, tabs 55, and legs 53 are integral (i.e., formed from a common piece of material). Securing portion 50 is configured to pressure fit and grip into drain pipe D such that upon installation, a lower part of securing portion 50 is located inside drain pipe D and an upper part of securing portion 50 is located above drain pipe D.

Tabs 55 include a rectangular portion 55*a* and a domed portion 55*b*. In the illustrated embodiment, domed portion 55*b* has a 9/16 inch diameter and thus rectangular portion 55*a* has a 9/16 inch width.

Figure 4:
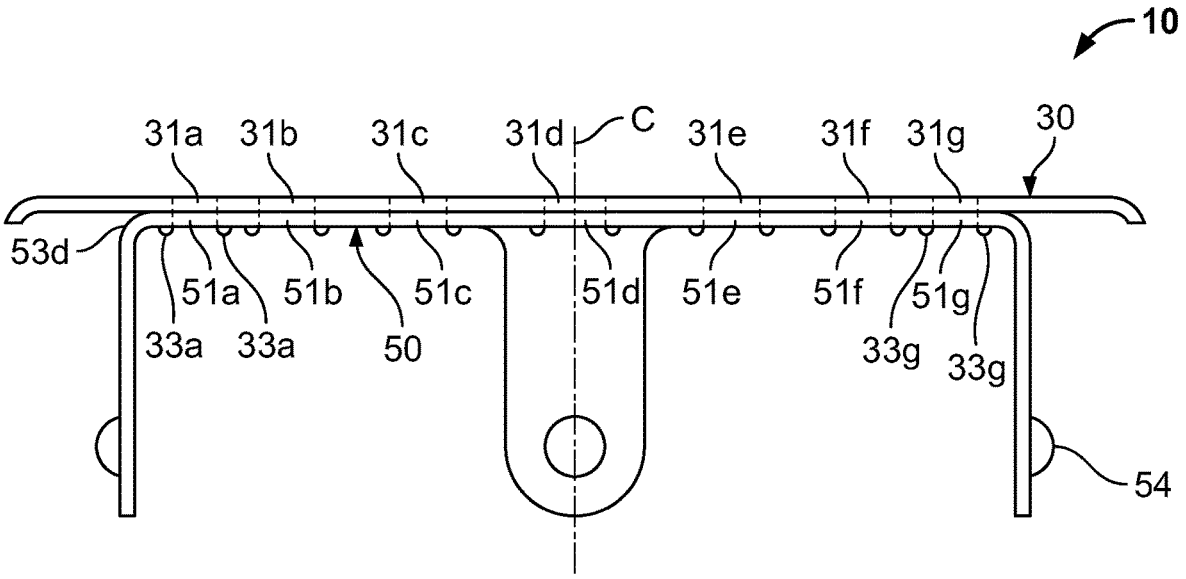
FIG. 4 is a side plan view of the fully assembled drain cover seen from the viewing plane of FIG. 1. Holes of the cover portion and the securing portion are hidden from this perspective and are thus dashed.

FIG. 1 shows reference segment I separating rectangular portion 55*a* from domed portion 55*b*. As shown in FIG. 1, tabs 55 extend at a common interval from plate portion 52, The total number of tabs 55 is equal to the total number of projections 32. FIG. 4 omits tabs 55 for clarity.

Upon installation, tabs 55 are configured to rest flush against floor surrounding drain pipe D (e.g., the shower base). As stated above, according to some embodiments, flat bottoms 32*b* also rest flush against floor surrounding drain pipe D. According to less preferred (but still advantageous) embodiments, flat bottoms 32*b* are vertically spaced (in a direction parallel to centerline C) from the floor. It should thus be appreciated that upon full assembly of drain cover 10, a length of a reference segment extending parallel to centerline C from top surface 35*a* to bottom 55*c* is greater than (according to some embodiments) or equal to (according to preferred embodiments) a length of a reference segment extending parallel to centerline C from top surface 35*a* to flat bottom 32*b*.

With reference to FIG. 3, plate portion 52 includes a flat top surface 52*a* and a flat bottom surface 52*b*. Because, as stated above, the diameter of plate portion 52 is less than the diameter of drain pipe D, upon installation, fluid may pass between a gap defined between plate portion 52 and drain pipe D.

Legs 53 include a curved portion 53*d*, a flat outer surface 53*a*, a flat inner surface 53*b*, and at least one dimple 54 extending from flat outer surface 53*a*. Dimples 54 are sized such that a reference diameter extending perpendicular to centerline C and joining outer-most tips of two opposing dimples 54 is greater than (according to some embodiments) or equal to (according to other embodiments) the diameter of drain pipe D. In the illustrated embodiment, a distance from the outer-most tip of dimple 54 to flat outer surface 53*a* is approximately 0.05 (±0.03) inches.

Upon installation into drain pipe D, dimples 54 contact the interior of drain pipe D and oppose vertical movement (along centerline C) of cover assembly 10 with respect to drain pipe D. When dimples 54 are sized such that the reference diameter joining outer-most tips of two opposing dimples 54 is greater than the diameter of drain pipe D, legs 53 flex radially inward upon installation. Because legs 53 are integral with plate portion 52, internal stresses in securing portion 50 bias legs 53 radially outward, thus enhancing contact between dimples 54 and drain pipe D.

Plate portion 52 of securing portion 50 defines holes 51. Upon full assembly, holes 51 are coaxial with holes 31 of cover portion 30. For examples, holes 31*a* to 31*g* are respectively coaxial with holes 51*a* to 51*g*. As a result, holes 31 and holes 51 share a similar arrangement.

According to less preferred (but still advantageous) embodiments described with reference to FIGS. 2*a*, 2*b*, and 5, holes 51 have a diameter equal to holes 31. Upon full assembly, draw necks 33 affect the effective diameter of holes 51, such that the effective diameter of holes 51 become approximately equal to the diameter of holes 31.

According to especially preferred embodiments described with reference to FIGS. 6*a* and 6*b*, holes 51 have a diameter greater than holes 31. Upon full assembly, draw necks 33 reduce the effective diameter of holes 51, such that the effective diameter of holes 51 may become equal to the diameter of holes 31.

Figure 2B:
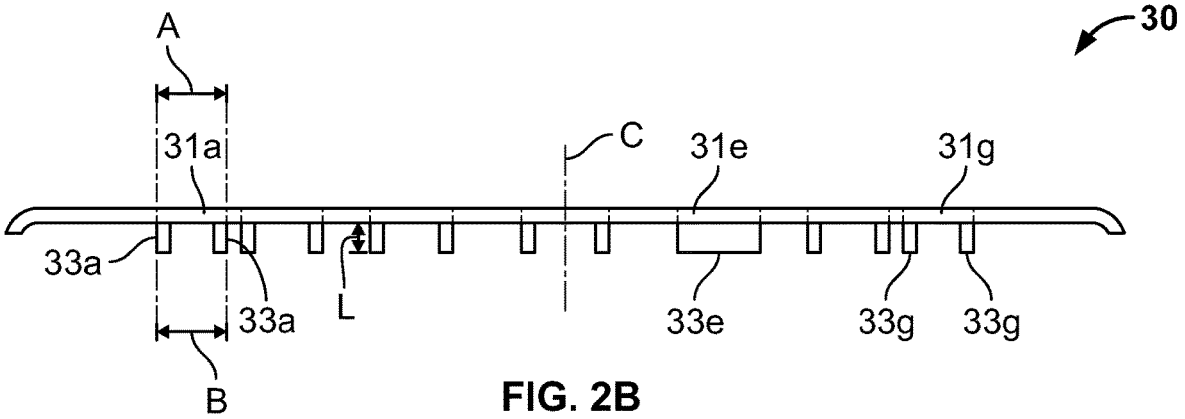
FIG. 2*b* is an expanded view of FIG. 2*a* with one of the draw necks including a closed perimeter. As discussed below, each of the draw necks may include the closed perimeter.
Figure 5:
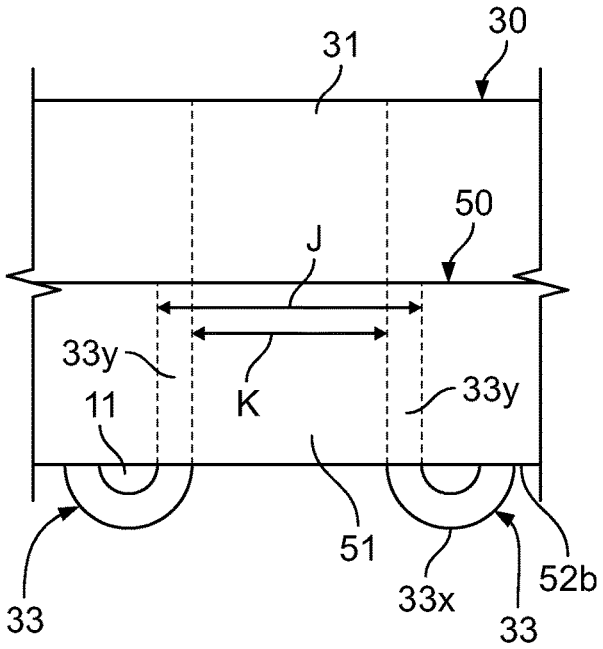
FIG. 5 is a partial side plan view of the cover portion mated with the securing portion upon full assembly.

As stated above, FIGS. 2*a*, 2*b*, and 5 show an embodiment of cover portion 30 prior to full assembly with securing portion 50. FIGS. 6*a* and 6*b* show another embodiment of cover portion 30 prior to full assembly with securing portion 50. As stated above, the embodiment of FIGS. 6*a* and 6*b* is preferred.

It should be appreciated that the embodiments of FIGS. 2*a*, 2*b*, 5, 6*a*, and 6*b* are similar (and in some cases, the same) except where otherwise apparent. Put differently, the features of FIGS. 1, 3, and 4 apply to the embodiment shown in FIGS. 2*a*, 2*b*, and 5 in addition to the embodiment shown in FIGS. 6*a* and 6*b*.

With respect to FIGS. 2*a*, 2*b*, and 5, a cylindrical tool pushes, stamps, or draws holes 31 in plate portion 35 of cover portion 30. It should be appreciated the term "draw" or "drawing" is a term of art and corresponds to a specific and known manufacturing process. It should be appreciated that although necks 33 are referred to as "draw necks 33," necks 33 may be produced by any suitable manufacturing process.

The pushing, stamping, or drawing process (now referred to as the "drawing process" for convenience), as applied to each hole 31, results in one or more draw necks 33. As shown in FIG. 2, the drawing process results in at least one draw neck 33*a* to 33*g* per respective hole 31*a* to 31*g*. Although not specifically illustrated, the draw necks 33 have circular, smooth, curved upper surfaces, and may be cylindrical or conical. For example, draw neck 33*a* may have an open top joining hole 31*a*, an open bottom, and a closed, continuous, and cylindrical or conical perimeter.

With reference to FIG. 2*b*, the drawing process for hole 31*a* has resulted in a cylindrical draw neck 33*a* having an outer diameter B equal to an inner diameter A of hole 31*a*. The drawing process for hole 31*a* applies to each hole 31 of cover portion 30. With reference to FIGS. 2*a* and 2*b*, portions of cylindrical draw neck 33*a* have been omitted for clarity (i.e., cylindrical draw neck 33*a* appears to have an open perimeter, when it actually has a closed perimeter). Cylindrical draw neck 33*e* has been drawn to show the closed perimeter. As stated above, each draw neck 33, including draw necks 33*a* to 33*g* may include the closed perimeter.

The partially assembled cover portion 30 of FIGS. 2*a* and 2*b* is positioned over and aligned with securing portion 50. Draw necks 33 extend through holes 51. Lengths L of each draw neck 33 (see FIG. 2*b*) are greater than lengths of holes 51 such that each draw neck 33 partially protrudes from each hole 51. At this point, bottom surface 35*b* of cover portion 30 lies flush against top surface 52*a* of securing portion 50.

With reference to FIG. 5, a tool presses or deforms the protruding portions of draw necks 33 radially outward and upward against bottom surface 52*b* of securing portion 50. The outwardly protruding portions of draw necks 33 now form a lamination-retention collar 33*x* (FIGS. 1, 5, and 6*b*) about lower surface 52*b*. Each draw neck includes a curved and/or flared lower surface of the retention collar 33*x*. The curved, flared lower surfaces of retention collars 33*x* lack readily accessible edges and, as any residual edges from manufacturing are inaccessible from the top surface (30) of an installed finished product, are therefore unlikely to cut a person's finger. Extension portions 33*y* of draw necks 33 extend through holes 51.

The deformed draw necks 33 thus (a) cover the sharp edges of bottom surface 52*b* defining holes 51 and (b) bind the cover portion 30 to the securing portion 50. Because draw necks 33 extend through holes 51, extension portions 33*y* of draw necks 33 resident in holes 51 decrease the effective diameter of holes 51. With reference to FIG. 5, diameter J represents a diameter of hole 51 prior to assembly. Diameter K represents a diameter of hole 51 upon assembly. The difference between diameters J and K is a thickness of extension portion 33*y*.

Figure 6A:
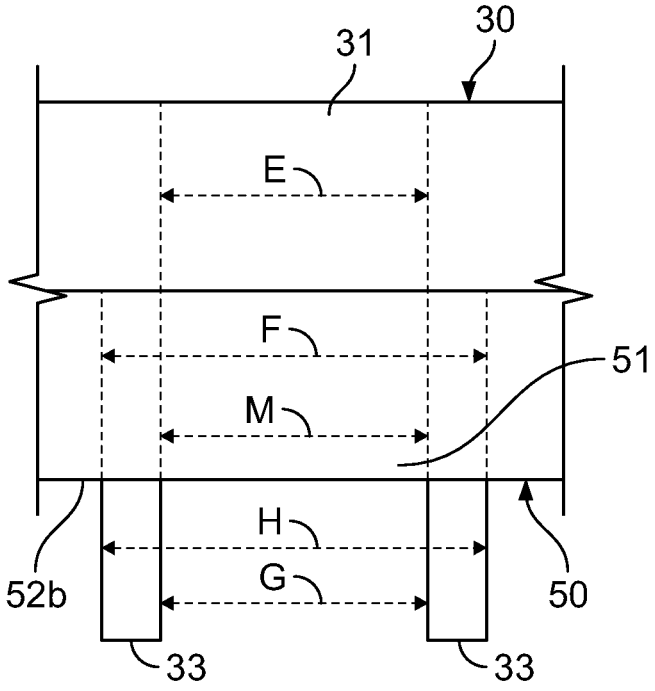
FIGS. 6*a* and 6*b* relate to an alternate embodiment of the drain cover.
Figure 6B:
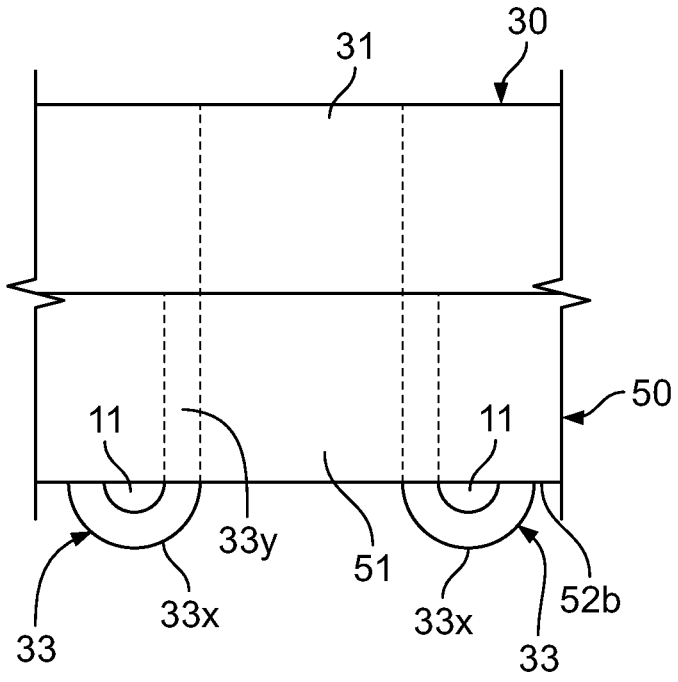

An alternate and especially preferred embodiment of drain cover 10 is shown with reference to FIGS. 6*a* and 6*b*. This alternate and especially preferred embodiment includes the same features of the previous embodiments, except where otherwise apparent. Although the second embodiment describes draw necks 33, it should be appreciated that the draw necks 33 need not be formed via a drawing process. However, application of a drawing process is especially preferred.

Prior to assembly, hole 31 has a diameter E. Cylindrical draw neck 33 is pushed, stamped, or drawn from hole 31 such that an inner diameter G of draw neck 33 is equal to diameter E of hole 31. Diameter H is an outer diameter of draw neck 33. As stated above with reference to FIGS. 2*a* and 2*b* (see draw neck 33*e* of FIG. 2*b*), draw neck 33 may be cylindrical with a closed outer perimeter.

Prior to assembly, hole 51 has a diameter F. Diameter F exceeds diameter E. According to preferred embodiments, diameter F of hole 51 is greater than outer diameter H of draw neck 33. According to other embodiments, diameter F of hole 51 is equal to outer diameter H of draw neck 33.

Cover portion 30 is positioned above and aligned with securing portion 50. Cover portion 30 is moved vertically downward until bottom surface 35*b* of cover portion 30 is flush against and in contact with top surface 52*a* of securing portion 50. Draw neck 33 now extends through and outwardly protrudes from hole 51.

As shown in FIG. 6*b*, a tool presses or deforms the protruding portions of draw neck 33 radially outward and upward against bottom surface 52*b* of securing portion 50. The outwardly protruding portions of draw neck 33 now form a lamination-retention collar 33*x* (see FIGS. 1, 5, and 6*b*) about lower surface 52*b*. A ring shaped gap 11 (exaggerated in the drawing for clarity) may be defined between draw neck 33 and lower surface 52*b*, although such a gap 11 is optional. The deformed draw neck 33 includes the curved and/or flared lower surface of the lamination-retention collar 33*x*. Because the retention collar 33*x* lacks accessible edges, the curved and/or flared lower surface of retention collar 33*x* is unlikely to cut a person's finger.

As shown in FIGS. 6*a* and 6*b*, extension portion 33*y* of draw neck 33 reduces the diameter of holes 51 from diameter F to diameter M. If draw neck 33 is formed properly, then diameter M of hole 51 will match diameter E of hole 31, although such a feature is not essential. The deformed draw necks 33 thus (a) cover the sharp edges of bottom surface 52*b* defining holes 51 with lamination-retention collars 33*x* that (b) laminate the cover portion 30 to the securing portion 50.

Some features of the above-described embodiments were discussed with reference to a single, representative hole 31, hole 51, draw neck 33, and lamination-retention collar 33*x*. It should be appreciated that such discussion equally applies to each hole 31, hole 51, draw neck 33, and lamination-retention collar 33*x*.

Furthermore, various features of the disclosure discusses various dimensions being equal. It should be appreciated that such discussion is intended to compensate for manufacturing tolerances. Put differently, when features or dimensions thereof are equal, such features or dimensions should be understood to be approximately equal. According to various embodiments, the term approximately accounts for 0.1%, 0.5%, 1%, 2%, 5%, or 10% tolerances.

The invention claimed is:

1. A drain cover comprising:

a cover portion comprising a first plate portion defining a plurality of first holes, the first plate portion comprising a first top surface and a first bottom surface;

a securing portion comprising a second plate portion, the second plate portion comprising a second top surface and a second bottom surface, the first bottom surface being flush against and in contact with the second top surface, the second plate portion defining a plurality of second holes coaxial with the first holes; and a plurality of draw necks comprising a corresponding plurality of neck extensions that form lamination-retention collars, wherein each of the plurality of neck extensions is drawn from and integral to the cover portion and extends through a corresponding second hole of the securing portion, and wherein each of the plurality of lamination-retention collars comprises an upper surface and a lower surface, the upper surfaces being at least partially flush against and in contact with the second bottom surface, the lower surfaces being flared.

2. The drain cover of claim 1, wherein the upper surfaces of the lamination-retention collars are pressed firmly against the second bottom surface, to laminate the first plate portion to the second plate portion, wherein the lower surfaces of the collars are flared.

3. The drain cover of claim 1, wherein the necks are cylindrical.

4. The drain cover of claim 3, wherein the second bottom surface comprises a plurality of edges, each of the plurality of edges surrounding and partially defining one of the second holes.

5. The drain cover of claim 4, wherein the plurality of collars cover the plurality of edges such that the plurality of edges are inaccessible.

6. The drain cover of claim 5, wherein at least one of the plurality of second holes has an original diameter defined by a first inner surface, and at least one of the extension portions has an inner diameter defined by a second inner surface and an outer diameter defined by a first outer surface, wherein the first outer surface of said extension portion at least partially contacts the first inner surface of said second hole.

7. The drain cover of claim 6, wherein inner diameters of the plurality of neck extensions are equal to diameters of the first holes and outer diameters of the plurality of neck extensions are equal to the diameters of the first holes.

8. The drain cover of claim 7, wherein the inner diameters of the plurality of second holes are marginally larger than the outer diameters of the plurality of extension portions.

9. The drain cover of claim 8, wherein the securing portion comprises a plurality of legs integral with the second plate portion.

10. The drain cover of claim 9, wherein each of the plurality of legs comprises at least one dimple.

11. The drain cover of claim 10, wherein the draw necks integrally extend from the first bottom surface of the cover portion.

12. The drain cover of claim 11, wherein the draw necks are fixed to, but non-integral with, the securing portion.

13. The drain cover of claim 12, wherein the draw necks are pressure stamped to form the retention collars that laminate the cover portion to the securing portion.

14. A drain cover comprising:

a cover portion comprising a first plate portion defining a plurality of first holes, the first plate portion comprising a first top surface and a first bottom surface;

a securing portion comprising a second plate portion, the second plate portion comprising a second top surface and a second bottom surface, the second plate portion defining a plurality of second holes coaxial with the first holes; and a plurality of draw necks comprising a corresponding plurality of neck extensions that form lamination-retention collars, wherein each of the plurality of neck extensions is drawn from and integral to the cover portion and extends through a corresponding second hole of the securing portion, and wherein each of the plurality of lamination-retention collars comprises an upper surface and a lower surface, the upper surfaces at least partially contacting the second bottom surface, the lower surfaces being flared.

15. The drain cover of claim 14, wherein the second bottom surface comprises a plurality of edges, each of the plurality of edges surrounding and partially defining one of the second holes, wherein the plurality of collars cover the plurality of edges such that the plurality of edges are inaccessible, the lower surfaces of the plurality of collars being flared.

* * * * *